US006774860B2

(12) United States Patent
Downs

(10) Patent No.: US 6,774,860 B2
(45) Date of Patent: Aug. 10, 2004

(54) UAV (UNMANNED AIR VEHICLE) SERVOING DIPOLE

(75) Inventor: Stuart G. Downs, San Diego, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 80 days.

(21) Appl. No.: 10/146,589

(22) Filed: May 15, 2002

(65) Prior Publication Data

US 2003/0214448 A1 Nov. 20, 2003

(51) Int. Cl.[7] ..... H01Q 3/00

(52) U.S. Cl. ..... 343/765; 343/711; 343/878; 343/766

(58) Field of Search ..... 343/878, 882, 343/765, 766, 711, 713, 705, 708; 244/17.13, 180

(56) References Cited

U.S. PATENT DOCUMENTS 3,866,859 A * 2/1975 Hill ..... 244/177
3,984,837 A * 10/1976 Tatnall ..... 343/705
4,786,912 A * 11/1988 Brown et al. ..... 343/761
5,202,695 A * 4/1993 Hollandsworth et al. ... 342/359
5,552,983 A * 9/1996 Thornberg et al. ..... 701/23
5,971,325 A * 10/1999 Gold et al. ..... 244/180
6,219,004 B1 * 4/2001 Johnson ..... 343/781 P

* cited by examiner

*Primary Examiner*—Tan Ho
(74) *Attorney, Agent, or Firm*—Suzanne J. Heeg

(57) ABSTRACT

Apparatus for controlling the rotational position of a dipole antenna (10) to compensate for roll and pitch movements of an unmanned air vehicle (UAV). The antenna (10) is connected to a dual-axis roll and pitch antenna mount (26), the rotational position is controlled by a pair of motor position control and feedback circuits (20 and 32). Roll error and pitch error signals (12 and 14) obtained from gyro systems in the UAV are subtractively combined with roll and pitch position signals, to generate control signals to be applied to rotate the antenna mount in a way that compensates for roll and pitch movements of the UAV, and effectively isolates the antenna mount from roll and pitch movements of the UAV. The dipole antenna (10), therefore, has its radiation pattern and polarization direction aligned with ground-based antennas, thus providing higher gain, increased range and more reliable performance.

15 Claims, 1 Drawing Sheet

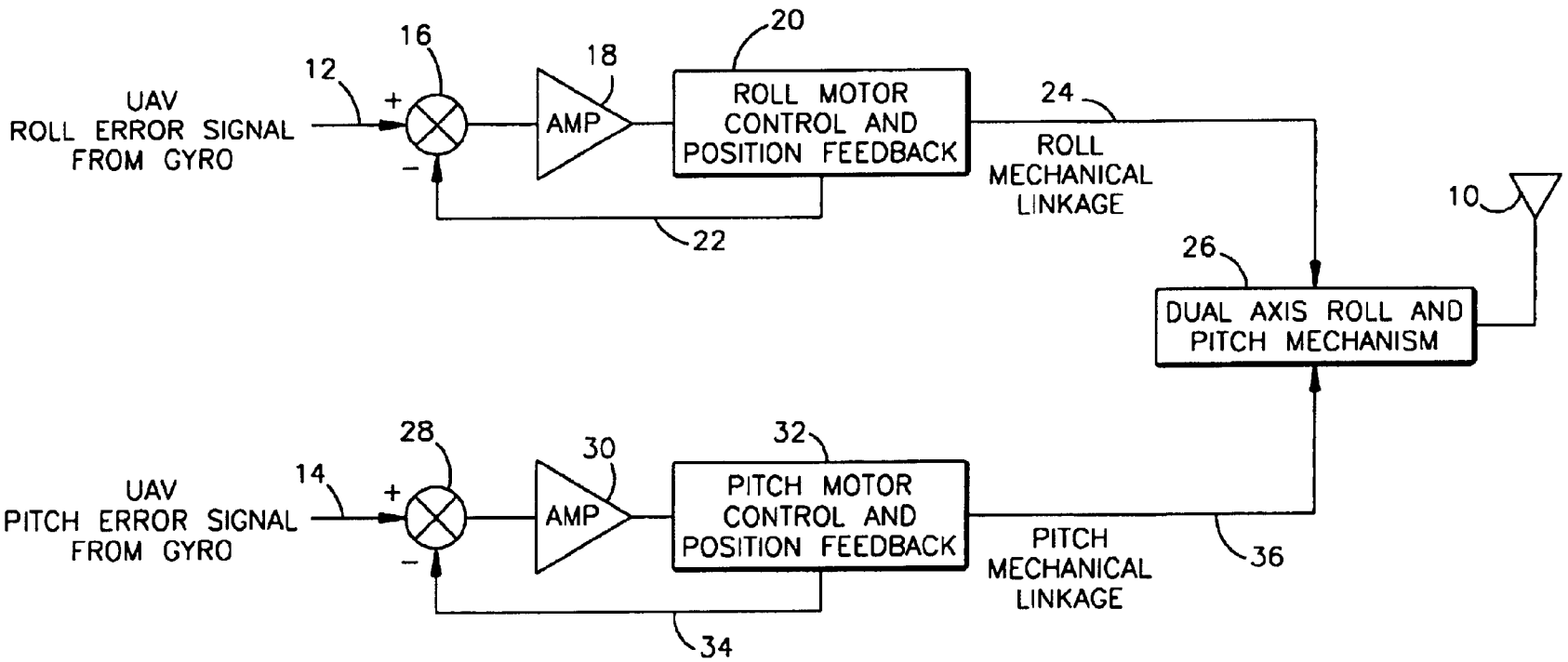
10
DUAL AXIS ROLL AND PITCH MECHANISM
26
24
ROLL MECHANICAL LINKAGE
36
PITCH MECHANICAL LINKAGE
20
ROLL MOTOR CONTROL AND POSITION FEEDBACK
32
PITCH MOTOR CONTROL AND POSITION FEEDBACK
22
34
18
AMP
30
AMP
16
28
12
14
UAV ROLL ERROR SIGNAL FROM GYRO
UAV PITCH ERROR SIGNAL FROM GYRO

UAV (UNMANNED AIR VEHICLE) SERVOING DIPOLE

BACKGROUND OF THE INVENTION

The present invention relates generally to radio-frequency (RF) antennas, and in particular to antennas used on unmanned air vehicles (UAVs). UAVs are increasingly used for surveillance, as communication repeater stations, or as targets in military applications. Scale model UAVs (model airplanes) are flown for recreation. In every application of a UAV, it is critical to maintain reliable RF communication between the vehicle and a ground station, which may be used for control of the vehicle or to transmit and receive communication signals.

Blade antennas are often used on aircraft, especially high-speed aircraft, for their convenient aerodynamic shape and generally omnidirectional radiation pattern, at least in azimuth. However, as the aircraft changes attitude, such as by turning or banking, the radiation pattern of the antenna is rotated with respect to the ground station, resulting in fluctuations in antenna gain. These fluctuations affect the link margin, which is generally defined as the amount by which a received signal exceeds a predetermined lower limit for desired message quality. Ultimately, the fluctuations adversely affect the range of the communication link. In addition, if the RF signals are vertically or horizontally polarized, the polarization angle of the antenna will vary with respect to the fixed polarization of an antenna at the ground station. These effects are for the most part tolerated in manned aircraft applications but have a more significant effect in UAV applications, in which it may be desirable to provide increased range and reliability of communication with ground stations.

Accordingly, there is a need for an antenna for UAVs that will provide better gain than blade antennas and yet be largely unaffected by changes in aircraft attitude. The present invention satisfies this need.

BRIEF SUMMARY OF THE INVENTION

The present invention resides in the use of roll and pitch error signals from an unmanned air vehicle (UAV) to isolate an antenna mount from rolling and pitching movement of the vehicle, such that the antenna radiation pattern and polarization direction will not be affected by these movements of the vehicle. Other aspects and advantages of the invention will become apparent from the following more detailed description, taken in conjunction with the accompanying drawings, of which the following is a brief description.

BRIEF DESCRIPTION OF THE DRAWINGS

The single drawing view is a block diagram showing the apparatus of the invention.

DETAILED DESCRIPTION OF THE INVENTION

As shown in the drawing for purposes of illustration, the present invention pertains to an aircraft antenna particularly well suited for use in unmanned air vehicles (UAVs). Use of conventional blade antennas is subject to range limitations caused by gain fluctuations resulting from changes in aircraft attitude.

In accordance with the present invention, existing roll and pitch gyro information in an unmanned air vehicle (UAV) is used to servo control a two-axis motor-driven system to maintain either vertical or horizontal polarization of a dipole antenna, which can be mounted in any convenient location on the vehicle. The dipole antenna is shown diagrammatically as indicated by reference numeral 10. The UAV includes a gyro attitude control system (not shown), which provides a roll error signal on line 12 and a pitch error signal on line 14. The roll error signal is input to a summer 16, in which a roll motor position signal is subtracted from the roll error signal on line 12. The difference signal from the summer 16 is amplified in amplifier 18 and transmitted to a roll motor control and position feedback circuit 20. This circuit provides a roll motor feedback signal on line 22 to the summer 16, and is mechanically linked, as indicated by line 24, to a dual-axis roll and pitch mechanism 26, which physically rotates the dipole antenna 10 about the roll and pitch axes of the vehicle. In operation, when the vehicle is flying straight and level there is no roll error signal from the gyro and no signal is applied to move the antenna about the roll axis. When the vehicle rolls in one direction or the other, a non-zero error signal on line 12 is amplified in the amplifier 18 and applied to effect a compensating movement of the antenna 10 about the roll axis. The position feedback signal on line 22 ensures that movement of the antenna tracks the roll error signal from the gyro.

The pitch error signal on line 14 is similarly processed through a summer 28, an amplifier 30 and a pitch motor control and position feedback circuit 32. A pitch motor feedback signal is fed back to the summer 28 over line 34, and the pitch motor control and position feedback circuit 32 generates a pitch control movement through the pitch mechanical linkage 36, coupled to the dual-axis roll and pitch mechanism 26. The latter device is a mechanical structure designed to be rotatable about two axes. The roll mechanical linkage 24 and pitch mechanical linkage 36 position this mechanism such that motions of the vehicle about the roll and pitch axes are compensated by opposite rotations of the mechanism, to which the antenna 10 is directly coupled. Thus, the dipole antenna 10 is also rotated about two axes to compensate for changes of vehicle attitude with respect to the pitch and roll axes. Rotation of the vehicle about a vertical yaw axis has a less significant effect than rotation about the other two axes, if the antenna is omnidirectional in azimuth. Since the antenna 10 is rendered virtually stationary in a pitch-and-roll rotational sense, polarization of its radiation pattern is kept aligned with that of a ground-based antenna. For example, if the antenna 10 and a corresponding antenna on the ground are horizontally or vertically polarized, the polarization direction of the antenna 10 will be maintained in alignment with the polarization direction of the ground based antenna.

More generally, because the antenna 10 is isolated from the roll and pitch movements of the vehicle, any gain fluctuations due to movement of the antenna radiation pattern about the roll and pitch axes are eliminated. Accordingly, the effective range of the antenna 10 is greater than that of an equivalent antenna subject to roll and pitch movements of the vehicle. Additionally, the gain of the dipole antenna 110 is greater than that of a blade antenna used for the same purpose, and the dipole antenna may be conveniently mounted anywhere on the vehicle. Because UAVs are generally low-speed aircraft, the use of electromechanical servo motors to compensate for roll and pitch rotations is a practical solution to the problem posed by the use of conventional blade antennas.

In view of the foregoing, it will be appreciated that the present invention represents a significant advance in the field of antennas for unmanned air vehicles. Specifically, the use of roll and pitch gyro data to compensate for roll and pitch movements of the vehicle provides for increased and more consistent antenna gain, whether the antenna is used for aircraft control or as part of a communications repeater station. It will also be appreciated that, although a specific embodiment of the invention has been described in detail for purposes of illustration, various modifications may be made without departing from the spirit and scope of the invention. Accordingly, the invention should not be limited except as by the appended claims.

What is claimed is:

1. An antenna system for an unmanned air vehicle (UAV), comprising:

a dipole antenna;

an antenna mount rotatable about roll and pitch axes of the UAV;

a first servo motor coupled to control rotation of the antenna mount about the roll axis;

a second servo motor coupled to control rotation of the antenna mount about the pitch axis;

a first feedback control system connected to the first servo motor to control rotation of the antenna mount about the roll axis in accordance with a roll error signal obtained from a gyro system in the UAV; and a second feedback control system connected to the second servo motor to control rotation of the antenna mount about the pitch axis in accordance with a pitch error signal obtained from a gyro system in UAV;

wherein the antenna mount is rotated to compensate for pitch and roll rotations of the UAV, thereby reducing fluctuations in antenna gain that would otherwise be caused by misalignment of a radiation pattern of the antenna with a related ground-based antenna.

2. An antenna system for an unmanned air vehicle (UAV), comprising:

an antenna mount rotatable about roll and pitch axes of the UAV;

an antenna mounted on the antenna mount; and means for compensating for changes of vehicle attitude with respect to the roll and pitch axes by rotating the antenna mount about the roll and pitch axes of the UAV opposite to rotations of the UAV to maintain the antenna radiation pattern in a desired alignment with a ground-based antenna.

3. An antenna system as defined in claim 2, wherein the means for rotating the antenna mount about roll and pitch axes includes:

a roll servo motor and a pitch servo motor coupled to the antenna mount;

a first feedback servo control circuit, including a first input circuit for receiving a UAV roll error signal from a gyro system on the UAV, a first summer circuit for subtracting a feedback roll position signal from the roll error signal, a first amplifier for amplifying the difference signal obtained from the summer circuit, and a first control circuit for controlling the roll position of the antenna mount from the amplified signal, and for feeding back a roll position signal to the summer circuit; and a second feedback servo control circuit, including a second input circuit for receiving a UAV pitch error signal from a gyro system on the UAV, a second summer circuit for subtracting a feedback pitch position signal from the pitch error signal, a second amplifier for amplifying the difference signal obtained from the second summer circuit, and a second control circuit for controlling the pitch position of the antenna mount from the amplified signal, and for feeding back a pitch position signal to the second summer circuit;

whereby the first and second feedback servo control circuits isolate the antenna mount from roll and pitch rotations of the UAV.

4. A method for improving gain and range of an unmanned air vehicle (UAV) antenna, the UAV antenna is mounted on an antenna mount that is rotatable about roll and pitch axes of the UAV, comprising the steps of:

compensating for roll and pitch movements of the UAV by applying roll and pitch rotations to the UAV antenna mount opposite to the motion of the UAV;

whereby the antenna has a radiation pattern that is maintained with its direction of polarization and its direction of maximum radiation in alignment with a ground-based antenna.

5. A method as defined in claim 4, wherein the compensating step includes:

obtaining roll and pitch error signals from a gyro system associated with the UAV; and controlling roll and pitch servo motors coupled to the antenna mount, using an amplified difference between respective error signals and respective position signals fed back from the antenna mount.

6. A method as defined in claim 5, wherein: the compensating step further includes:

subtracting roll and pitch antenna mount position signals from the respective roll and pitch error signals to obtain roll and pitch difference signals;

amplifying the roll and pitch difference signals; and applying the amplified signals to roll and pitch control circuits.

7. A method as defined in claim 5, wherein the UAV antenna is a dipole antenna.

8. An antenna system for an unmanned air vehicle (UAV), comprising:

an antenna mount rotatable about roll and pitch axes of the UAV;

an antenna mounted on the antenna mount; and a compensation system configured to compensate for motions of the UAV by rotating the antenna mount to maintain the antenna radiation pattern in a desired alignment.

9. The antenna system of claim 8, the compensation system further comprising:

a first servo motor coupled to control rotation of the antenna mount about the roll axis; and a second servo motor coupled to control rotation of the antenna mount about the pitch axis.

10. The antenna system of claim 9, the compensation system further comprising:

a first feedback control system connected to the first servo motor to control rotation of the antenna mount about the roll axis in accordance with a roll error signal obtained from a gyro system in the UAV; and a second feedback control system connected to the second servo motor to control rotation of the antenna mount about the pitch axis in accordance with a pitch error signal obtained from a gyro system in UAV.

11. The antenna system of claim 10, the antenna comprises a dipole antenna.

12. The antenna system of claim 8, wherein the desired alignment is with a ground-based antenna.

13. The antenna system of claim 8, the compensation system compensates for motions of the UAV by rotating the antenna to maintain the antenna radiation pattern in a desired alignment.

14. The antenna system of claim 8, wherein the compensation system is configured to compensate for motions of the UAV about the roll and pitch axes by rotating the antenna in a direction opposite the motions of the UAV.

15. The antenna system of claim 8, the compensation system maintains one of a horizontal polarization and a vertical polarization.

* * * * *